United States Patent [19]

Hogg

[11] Patent Number: 4,536,036

[45] Date of Patent: Aug. 20, 1985

[54] PINLESS HAULAGE DRIVE CHAIN AND RACK-FORM LINK FOR USE SERIATIM IN FORMING SAME

[75] Inventor: Thomas M. Hogg, Wishaw, Scotland

[73] Assignee: Anderson Strathcylde Plc, Glasgow, Scotland

[21] Appl. No.: 664,744

[22] Filed: Oct. 24, 1984

Related U.S. Application Data

[63] Continuation of Ser. No. 437,529, Oct. 29, 1982, abandoned.

[30] Foreign Application Priority Data

Oct. 31, 1981 [GB] United Kingdom ..... 8132885

[51] Int. Cl.[3] ..... E21C 35/20

[52] U.S. Cl. ..... 299/43; 305/50

[58] Field of Search ..... 299/42, 43, 51–54; 74/422, 457; 105/29 R; 305/50, 56

[56] References Cited

U.S. PATENT DOCUMENTS 3,680,927 8/1972 Neureuther ..... 305/50 X 4,088,370 5/1978 Jarvis et al. ..... 299/43

FOREIGN PATENT DOCUMENTS 1292076 10/1972 United Kingdom ..... 299/43

*Primary Examiner*—James A. Leppink

*Assistant Examiner*—Thuy M. Bui

*Attorney, Agent, or Firm*—Mason, Fenwick & Lawrence

[57] ABSTRACT

A pinless haulage drive chain formed of a series of rack-form link components each having complementary shaped parts at opposite ends, one end of which has a projection of T-shaped in plan view and the other end having a recess of T-shape in plan view to receive as a clearance fit the projection of an adjoining link component. Each link component also has a central spine of upstanding rack formation and integral therewith on either side thereof two walls forming a saddle having a wall of lesser depth to be used as a trapping means for a mineral mining machine on its traverse along a conveyor, and a deeper wall to be encompassed by trapping means for the link itself via a shoulder extending from this wall. The chain may be used in a scraper chain conveyor comprising conveyor line pans having a range of movement therebetween. The summation of the clearances between projections and recesses in the set of successive link components is at least equal to the total movement obtainable between any pair of conveyor pans.

7 Claims, 3 Drawing Figures

PINLESS HAULAGE DRIVE CHAIN AND RACK-FORM LINK FOR USE SERIATIM IN FORMING SAME

Figure 1:
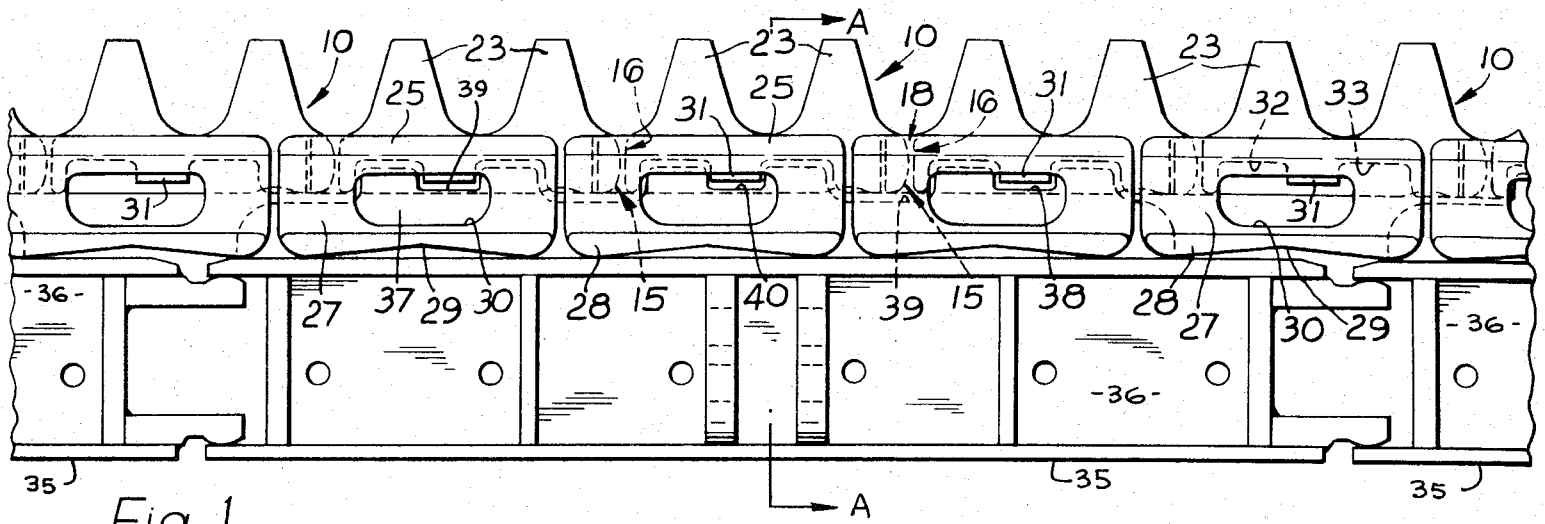

This is a continuation of application Ser. No. 437,529, filed Oct. 29, 1982 now abandoned.

The invention relates to a pinless haulage drive chain for co-operating with the drive element of a mining machine to generate travel longitudinally along a mine working face, and to a rack-form link for use seriatim in forming said pinless chain.

It is known to mount mining machines, such as a machine with a cutter drum, on or adjacent to the frame of a chain scraper conveyor which is laid along the mine working face and to provide guide means thereby for the travel of the machine along this face.

It is also known to incorporate on the conveyor frame means for accepting a rack assembly with which the drive sprocket of the machine co-operates to generate travel of the machine along the mine working face.

These means usually require that a rack element be slideably secured within fixed limits to the conveyor in a manner such that the correct pitched engagement of the machine drive sprocket therewith is assured whilst accommodating the undulations of the floor and the advance or resetting movements of the conveyor. Invariably this necessitates securing the rack elements by bolting or similar means to each conveyor pan and linking these rack elements one to another so as to control the error in pitch which arises as the pans articulate in the horizontal and vertical planes. This controlling influence adversely affects the flexibility of the conveyor itself in that this flexibility is considerably reduced.

It is an object of the invention to produce a pinless haulage drive chain the design of which will enable a combination of sets of individual rack form loose links to co-operate within a containing and restraining means, the latter being secured to each conveyor pan, so that each set of links is located relative to the pan to which the restraining means is secured and free articulation of the links is permitted in any direction whilst limiting the degree of pitch error occurring due to the 'snaking' effect of the conveyor as a whole when moving over to form a fresh machine guidance track, such articulation when summed for each set of links being at least equal to the total movement obtainable between any pair of conveyor pans.

In accordance with the present invention we provide a rack form link component adapted for loose interfitment with like rack form link components to form a chain free of hinge pins and co-operable with a drive roller means, said link component having complementary shaped parts at its opposite ends, one end having a projection of T-shape in plan view and the other end having a recess of T-shape in plan view to receive as a clearance fit the projection of the adjoining link, a central spine of upstanding rack formation and integral therewith on either side of the spine two walls of the same length but one vertically deeper than the other thus forming a saddle, the shorter wall being used as trapping means for a mineral mining machine on its traverse along a conveyor, the deeper wall to be encompassed by trapping means for the link itself via a shoulder extending from this wall, and locating means on the link situated within the saddle in the form of a block positioned on the underside of the rack formation spine.

Further in accordance with the present invention, a pinless haulage drive chain co-operable with a drive roller means comprise a series of like rack form link components loosely interfitted seriatim and each having complementary shaped parts at its opposite ends, one end having a projection of T-shape in plan view and the other end having a recess of T-shape in plan view to receive as a clearance fit the projection of the adjoining link component, a central spine of upstanding rack formation and integral therewith on either side of the spine two walls of the same length but one vertically deeper than the other thus forming a saddle, the wall of lesser depth being used as trapping means for a mineral mining machine on its traverse along a conveyor, the deeper wall to be encompassed by trapping means for the link itself via a shoulder extending from this wall, and locating means on the link situated within the saddle in the form of a block positioned on the underside of the rack formation spine.

Also in accordance with the present invention a scraper chain conveyor comprises conveyor line pans and a mining machine moveable therealong, said pans having elongate box sections attached thereto, characterised in that each box section approximates to the length of a conveyor pan and carries on its top surface a spine of rectangular cross section secured to and extending longitudinally of the box section, the spine having along the length of its top surface a series of cavities of which one is positioned approximately midway of the length of the spine and is dimensioned to be a locating fit for a block at the underside of the upper wall of a rack form link component of a pinless haulage drive chain as defined in the immediately preceding paragraph and of which the others are symmetrical about said one cavity and are clearance fits in the first case for the remaining blocks within the set of link components and in the second case for the lower parts of the interfitting formations at the ends of successive link components, and the summation of the clearances between projections and recesses in the set of successive link components being at least equal to the total movement obtainable between any pair of conveyor pans.

Figure 3:
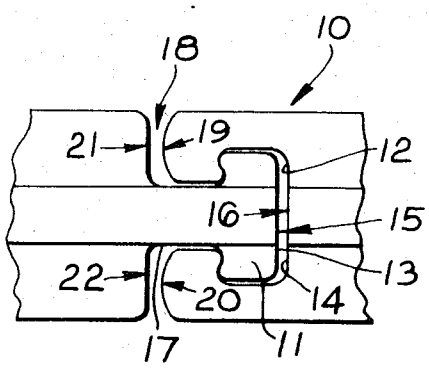
Figure 2:
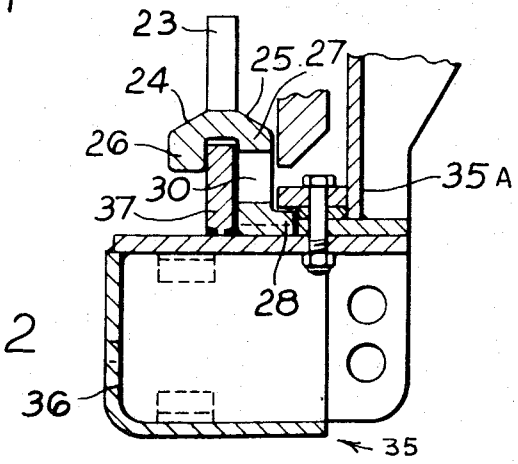

An embodiment of the invention will now be described, by way of example, with reference to the accompanying drawing, wherein:

FIG. 1 is a side elevation of a length of a pinless haulage drive chain in accordance with the invention fitted in operative relation to a mounting and restraining arrangement therefor secured to each conveyor pan of a chain scraper conveyor, the view showing only the base portion of a line pan or conveyor pan and parts of each conveyor pan with slide curb portions or furnishings and upwardly projecting slide portions or furnishings not shown fore and aft of the complete pan;

FIG. 2 is a vertical section through a link of the chain and the mounting and restraining arrangement, taken along the line A—A of FIG. 1 and showing additional fragmentary portions of the side curb and upwardly extended side portions or furnishings and a fragmentary portion of the mining machine; and FIG. 3 is a fragmentary plan view, on double the scale of the other views, illustrating the interconnection of successive rack-form links forming the pinless haulage chain.

Referring now to the drawing, a pinless haulage drive chain comprises a series of identical rack-form link components or links 10 interconnected end-to-end seriatim. Each link 10 considered in horizontal section, has a T-shaped projection 11 at one end and a T-shaped recess 12 at the other, both the projection and the recess being symmetrical about the median vertical plane of the link with the bars 13 and 14 of the tees similarly oriented. As will be apparent from FIG. 3, the bar 13 of the projection is a clearance fit in the head of the recess 12, formed by the bar 14. As will be apparent from FIG. 1, the outer face 15 of the projection 11 is convexly curved considered in side elevation, while the inner face 16 of the recess 12 is plane. The stem 17 of the projection 11 is longer than the corresponding portion of the recess 12 whereby there is a gap 18 between the proximate ends of successive links 10 when interfitted. The end surfaces 19,20 of the links flanking the stem portion of the recess 12, i.e. the surfaces thereof fronting the gap 18, are convexly curved transversely while the opposing surfaces 21,22 at the other side of the gap 18 are plane (see FIG. 3). As can also be seen clearly in FIG. 3, all corners are radiused transversely.

Each link 10 has a central upstanding spine of rack formation providing two teeth or cogs 23, the surfaces 24,25 of the link 10 sloping downwardly in the outward direction at each side of the spine to meet through radiused edges the outer surfaces of depending vertical flanking walls 26,27 of the link 10 form a saddle for location of the link over a spine 37 on the conveyor pan as hereinafter described. The wall 26 is substantially reduced in depth, whereas the wall 27 is of full depth and is provided at its lower end with an outturned shelf or shoulder 28. The wall 27 and the shelf 28 are together bevelled longitudinally at their undersides as can be seen at 29 in FIG. 1. An elongate opening 30 is provided through the wall 27 and a block 31 bridges the gap between the walls 26 and 27 at the upper part thereof and interspaces two recesses 32 and 33 at the underside of the upper wall of the link directly below the spine.

The line pans 35 of a scraper chain conveyor, along which a mining machine is moveable, have elongate box sections 36 secured thereto to project laterally from the bottoms thereof. Each box section 36 approximates to the length of a conveyor pan and carries on its top surface a longitudinal spine 37 secured thereto and over which the saddle of four links locate as illustrated in FIG. 1. The spine 37 has along the length thereof in its upper surface a series of rectangular cavities 38,39 and 40, the cavities 38 and 39 being positioned symmetrically about cavity 40, the latter being a locating fit for a block 31 of a link 10 and the former being respectively a clearance fit for block 31 of the adjacent link 10 and a clearance fit for the lower part of the interfitting formation at the ends of adjacent links. 35 A denotes a furnishing attached to the line pan 35.

I claim:

1. A rack form link component adapted for loose interfitment with like rack form link components to form a chain free of hinge pins and co-operable with a drive roller means, said link component having opposite ends of mutually complementary shape one said end forming a projection of T-shape in plan view and the other said end forming a recess of T-shape in plan view to receive as a clearance fit the projection of an adjoining link component, a central upstanding spine of rack formation and integral therewith on either side of the spine two walls of the same length but one vertically deeper than the other thus forming a saddle, the shallower wall being used as trapping means for a mineral mining machine on its traverse along a conveyor, the deeper wall to be encompassed by trapping means for the link itself via a shoulder extending from this wall, and locating means situated within the saddle and in the form of a block positioned on the underside of the rack formation spine.

2. A rack form link component as claimed in claim 1, wherein both the projection and the recess are symmetrical about the median vertical plane of the link.

3. A rack form link component as claimed in claim 1 or 2, wherein the outer face of the projection is convexly curved considered in side elevation and the corresponding face at the inner end of the recess is plane.

4. A rack form link component as claimed in claim 3, and convexly curved transversely at the end surfaces thereof flanking the stem portion of the recess and plane at the end surfaces thereof flanking the stem portion of the projection.

5. A rack form link component as claimed in claim 1 or 2, and convexly curved transversely at the end surfaces thereof flanking the stem portion of the recess and plane at the end surfaces thereof flanking the stem portion of the projection.

6. A pinless haulage drive chain co-operable with a drive roller means and comprising a series of like rack form link components loosely interfitted seriatim and each having opposite ends of mutually complementary shape, one said end forming a projection of T-shape in plane view and the other said end forming a recess of T-shape in plan view to receive as a clearance fit the projection of an adjoining link component, a central upstanding spine of rack formation and integral therewith on either side of the spine two walls of the same length but one vertically deeper than the other thus forming a saddle, the shallower wall being used as trapping means for a mineral mining machine on its traverse along a conveyor, the deeper wall to be encompassed by trapping means for the link itself via a shoulder extending from this wall, and locating means situated within the saddle and in the form of a block positioned on the underside of the rack formation spine.

7. A scraper chain conveyor comprising a plurality of conveyor line pans connected seriatim along which a mining machine is moveable, said pans having elongate box sections attached thereto of length approximate to the length of a conveyor pan, a spine of rectangular cross section secured to and extending longitudinally of the top surface of the box section and a series of cavities along the length of te top surface of the spine of which one is positioned approximately midway of the length of the spine and of which the others are symmetrical about said one cavity, a pinless haulage drive chain co-operable with a drive roller means and comprising a series of like rack form link components loosely interfitted seriatim and each having opposite ends of mutually complementary shape, one said end forming a projection of T-shape in plane view and the other said end forming a recess of T-shape in plan view to recieve as a clearance fit the projection of an adjoining link component, a central upstanding spine of rack formation and integral therewith on either side of the spine two depending walls of the same length but one vertically deeper than the other thus forming a saddle for location of the link component over the spine of the line pan, the shallower wall being used as a trapping means for a mineral mining machine on its traverse along a conveyor, the deeper wall to be encompassed by trapping means for a the link itself via a shoulder extending from this wall, and locating means situated within the saddle and in the form of a block positioned on the underside of the rack formation spine, the one cavity of the spine of the link component having a dimension to fittingly locate the block at the underside of the upper wall of the rack form link component and the other cavities have dimensions one to loosely locate the remaining blocks within a set of successive interfitted link components co-operating with the spine and the other for the lower part of the interfitting formations at the adjacent ends of successive link components of the set, and the summation of the clearances between projections and recesses in the set of successive link components being at least equal to the total movement obtainable between any pair of conveyor pans.

* * * * *